United States Patent [19]

Tipper

[11] 4,173,235

[45] Nov. 6, 1979

[54] METHOD AND APPARATUS FOR FORMING WIRE TO NONCIRCULAR CROSS SECTIONS

[76] Inventor: Maynard J. G. Tipper, 25 Melrose Ct., Hillsborough, Calif. 94010

[21] Appl. No.: 907,738

[22] Filed: May 19, 1978

[51] Int. Cl.[2] ..... B21F 45/22

[52] U.S. Cl. ..... 140/82; 72/183

[58] Field of Search ..... 140/82, 83; 72/183, 72/206

[56] References Cited

U.S. PATENT DOCUMENTS

| | | | |
|---|---|---|---|
| 352,254 | 11/1886 | Mower | 140/82 |
| 3,407,852 | 10/1968 | Lang | 72/183 |
| 3,525,096 | 8/1970 | Klenz | 140/82 |

*Primary Examiner*—Lowell A. Larson

*Attorney, Agent, or Firm*—Gordon Wood

[57] ABSTRACT

A length of wire is formed to a noncircular cross section preparatory to forming the wire into clips. The noncircular cross section is formed by a pair of rollers and the rolled wire is oriented for use in the clip forming machine by guiding the rolled wire in a relatively large loop so that the tendency for the wire to twist after rolling is readily overcome and so that the proper orientation of the wire is achieved while feeding the wire to the clipping apparatus.

9 Claims, 5 Drawing Figures

Fig. 1.
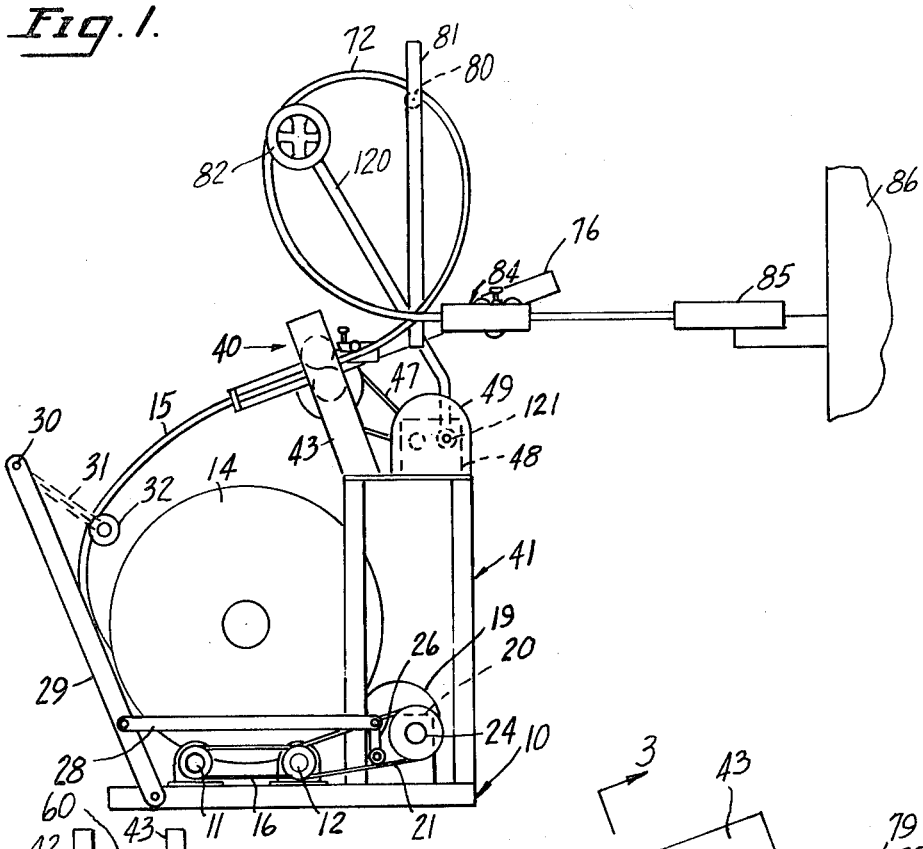
Fig. 2.
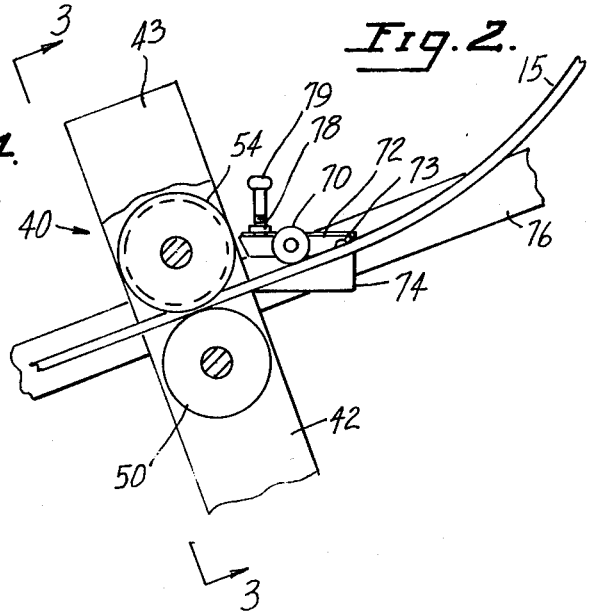
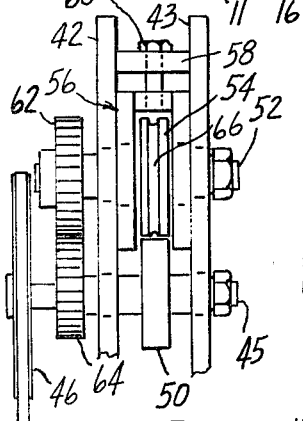
Fig. 4.
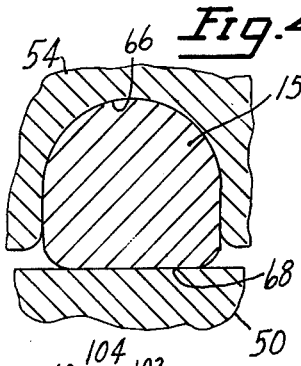
Fig. 3.
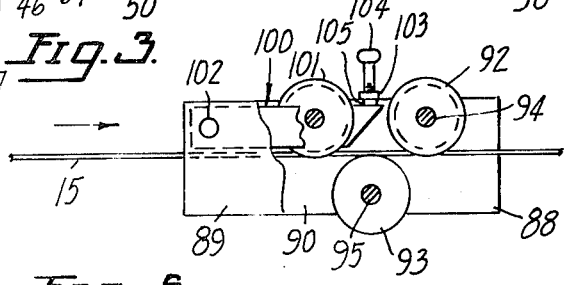
Fig. 5.

METHOD AND APPARATUS FOR FORMING WIRE TO NONCIRCULAR CROSS SECTIONS

This invention relates to the art of forming U-shaped clips from a length of wire and is particularly adapted to use when the wire from which the clips are formed is of noncircular cross section. Examples of the type of clips to which the present invention relates are shown in U.S. Pat. Nos. 3,400,433 and 3,525,096. In the latter patent a method is disclosed for forming a conventional circular wire to a noncircular shape which includes a flat side which subsequently becomes the inner side of the clip when the latter is formed to a U-shape.

Said U.S. Pat. No. 3,525,096 teaches the use of rollers to form the wire to noncircular cross sectional shape during the feeding step at which the wire is fed into the clipping apparatus. In this manner there is no tendency for the wire to twist during the feeding and clip forming steps.

In some instances it is preferable to form the wire to noncircular cross section at a point well ahead of the feeding step to the clip former. When this is done, however, it is necessary to provide means for orienting the wire properly as it is fed through the clip forming apparatus and eliminating or overcoming any tendency of the wire to twist and bend.

As pointed out in U.S. Pat. No. 3,525,096 when wire is rolled to a noncircular cross section and especially one having a flat side there is an inherent tendency for the rolled wire to twist after forming thereby making it difficult to feed the wire to the clipper in its proper orientation.

The tendency for the wire to twist after rolling is controlled by a simple method and apparatus according to the present invention so that it may be fed to the clipping machine in its proper orientation relative to its longitudinal axis.

One of the advantages accruing from the use of the present invention is that conventional feeders for feeding the wire a measured amount on each stroke to the clip forming apparatus may be employed.

Another advantage is that the rolling of the wire to noncircular cross section may be achieved at any convenient location with respect to the clipping apparatus, thereby obviating any modifications to the conventional clip forming machine.

Other advantages will be apparent from the following specification and from the drawings.

FIG. 1 is a reduced scale side elevation of the apparatus of the present invention.

FIG.2 is an enlarged side elevation, partly broken away, of the wire forming means.

FIG. 3 is an end elevation of the structure of FIG. 2 as taken in a plane indicated by 3—3 in FIG. 2.

FIG. 4 is a greatly enlarged semischematic cross section through the forming rolls showing the wire formed to a noncircular cross sectional shape that includes a flat side.

FIG. 5 is an enlarged side elevation partly in section of the wire straightening device.

In detail, and first with reference to FIG. 1, the apparatus of the invention includes a base 10 on which a pair of rotatably supported shafts 11, 12 are provided for rolling a drum 14 of wire about its center for feeding a length of wire 15 from said drum. The shafts 11, 12 are provided with suitable pulleys so that they may be driven in the same direction through chain or belt 16 with the shaft 12 being driven from a motor 19 and variable speed reducer 20 by means of a chain or belt 21. The speed of the output shaft 24 of speed reducer 24 is controlled by a conventional speed regulator which includes a crank 26 which is swingable to achieve different output speeds by means of a relatively long link 28 pivotally secured at its opposite end to one of a pair of generally upwardly extending arms 29. The two arms 29 straddle the drum 14 and are connected by means of a cross piece 30 to which is secured a chain 31 connected to a sheave 32 over which the wire 15 runs.

At this point it will be noted that if the speed of feed or wire 15 is increased over that feed required by the subsequent operations the loop of wire coming from the drum 14 will move toward the left in FIG. 1. This movement has the effect of turning crank 26 of the variable speed power reducer 20 to reduce the speed of rotation of drum 14. If the wire is being used at a greater speed than it is being discharged from drum 14 the loop of wire will tend to move to the right reversing the direction of link 28 and increasing the feeding speed.

The above described speed control means is not shown in detail as the same is conventional and no claim is made to the same except in combination with the invention to be disclosed.

The wire from drum 14 is fed first to a forming device which is best seen in FIGS. 2, 3. Said device is supported on a table generally designated 41 (FIG. 1) to the top of which are secured a pair of upwardly slanting side plates 42, 43. As best seen in FIG. 3 a drive shaft 45 is rotatably supported in side plates 42, 43 by means of suitable bearings and is provided with a drive pulley 46 by means of which shaft 45 is driven through belt 47 from a speed reducer 48 mounted on table 41. Said speed reducer is driven by motor 49 which is also mounted on said table. In the particular form of the invention disclosed a forming roller 50 having a plain cylindrical surface is mounted on shaft 45.

Spaced upwardly from shaft 45 is another shaft 52 on which is mounted an upper forming roller 54 which is rotatably supported in an inverted U-shaped saddle 56 which is slidably received between the opposed faces of side plates 42, 43. Spaced upwardly from saddle 56 is a cross piece 58 fixedly secured to side walls 42, 43 and through which a bolt 60 is passed into threaded engagement with the upper end of saddle 56. Depending on the rotation of bolt 60 the saddle 56 and the upper form roll 54 may be moved slightly upwardly or downwardly to achieve the particular wire shape desired. Shaft 52 passes through suitable enlarged openings in side plates 42, 43 and is provided with a gear 62 which meshes with a similar gear 64 on driving shaft 45. By this structure the shafts 45, 52 are driven at substantially the same rotational speed.

In the example disclosed herein the upper roll 54 is formed with a groove 66 which is best seen in FIG. 4. With reference to FIG. 4 it is seen that the lower roller 49 has the effect, in cooperation with the roller 54, of forming the wire 15 with a flat side 68 which subsequently becomes the inner face of the U-shaped clip formed by the clipping apparatus.

After passing through the rollers 50, 54 the wire is engaged by a roller 70 (FIG. 2) and is then formed to a relatively large loop 72 which is shown in a substantially vertical plane in FIG. 1. At this point it should be noted that the deformation of the wire shown in FIG. 4 has the effect of tending to bend the wire in a vertical plane to a loop having a relatively small radius of curvature. By providing the roller 70 (FIG. 2) the wire may be partially straightened toward its original relatively straight condition so that the actual size of the loop 72 may be adjusted as desired. The means for adjusting the size of the loop is shown in FIG. 2 in which the roller 70 is rotatably supported on an elongated arm 72 which is pivotally supported as at 73 to a block 74 which may in turn be secured in any desired manner to an elongated support arm 76 which is in turn secured to the side plate 42 of the previously described rolling mechanism. The block 74 is provided with a bar 78 overhanging the lever 72 and threadedly secured within said bar is an adjusting bolt 79 by means of which the roller 70 may be moved toward or away from wire 15 thus providing means for adjusting the size of loop 72.

The actual shape of loop 72 is controlled first by a roller 80 rotatably supported on an upwardly extending bar 81 which may be secured at its lower end to bar 76. The loop is also engaged by a relatively large diameter grooved wheel 82 before the wire proceeds to a straightening device indicated generally at 84 in FIG. 1. From the straightening device 84 the wire proceeds to a conventional punch press feeder such as one of the type available under the trademark RAPIDAIR. The feeder 85 then feeds the wire in intermittent equal steps to a conventional clip forming punch indicated at 86 and which may be of the general type shown in Pat. No. 3,525,096 or 3,626,994.

Returning to the straightening device 84 the same comprises a block 88 which is secured to arm 76 in any convenient manner and which includes a pair of side plates 89, 90 between which are rotatably supported an upper grooved roll 92 and a lower plain cylindrical roll 93. Said rolls are rotatably supported on shafts 94, 95 respectively. Also supported between side plates 89, 90 is a yoke 100 which is pivotally supported at one end on a pivot 102 extending between side plates 89, 90 and which yoke rotatably supports a roll 101. A bar 103 is secured at its opposite ends to the upper edges of side plates 89, 90 and is provided with a threaded adjusting bolt 104. This bolt 104 bears on a strap 105 secured to the inner end of yoke 100 to permit adjusting the pressure of roll 101 so that, in cooperation with rolls 92, 93, the wire 15 may be bent to a perfectly straight condition. The upper rolls 92, 101 are each provided with a peripheral groove similar to groove 66 of roll 54 so that they not only contribute to the straightening function but also, in conjunction with lower plain cylindrical roll 93, automatically assist in orienting the wire 15 so that the same leaves the straightener 84 with the flat side 69 (FIG. 4) directed downwardly thereby permitting the feeder 85 to feed the clips to the clip forming step properly oriented.

At this point it will be noted that the proper orientation of the wire is substantially all attributable to the loop 72. The reason for this is that, as the wire is formed by rolls 50, 54 the bottom flat side becomes elongated thus causing the formation of the loop with its center of curvature on the side opposite the flat side. Thus, at the outgoing end of the loop 72, the flat side of the wire is naturally directed downwardly achieving the object of the invention. The rolls 92, 93 and 101 also, of course, contribute in some measure to the desired result.

One of the important features of the present invention is that the wire 15 approaching the feeder 85 has neither any tensile or compressive stress in the direction of feed so that the feeder 85 can feed the same accurately. This result is achieved by means of the grooved wheel 82 previously referred to and which is in engagement at its periphery with the loop 72. This wheel 82 is rotatably supported at the end of an elongated arm 120 which in turn is secured at its other end to the control shaft 121 of the variable speed output 48 which drives the forming rolls 49, 54. In this connection it can be seen from FIG. 1 that if the forming rolls 50, 54 are rolling the wire outwardly therefrom at too fast a speed the loop 72 will increase in size causing the wheel 82 to move to the left. This movement in turn reduces the output speed of the variable speed reducer 48 thereby slowing the rotation of the forming rolls 50, 54. If on the other hand the forming rolls 50, 54 are rolling the wire at too slow a speed the wheel 82 will move to the right causing the speed of the forming rollers to be increased. In this manner the proper speed for moving the wire between the forming and feeding steps is accurately determined.

It will be seen that the above described invention not only provides a convenient means for rolling the wire to noncircular cross section but an inexpensive and simple means is provided for orienting the wire in its proper orientation against its tendency to bend or to twist about its longitudinal axis.

I claim:

1. In the method of making a clip of noncircular cross section in a wire cutting and forming means the steps of:
- providing a source of wire,
- feeding said wire from said source,
- forming said wire to a noncircular cross section during the feeding thereof,
- guiding the formed wire to orient the same in a relatively large loop and thereafter,
- feeding the formed wire from said loop to said wire cutting and forming means.

2. The method of claim 1 wherein said noncircular cross section includes a flat on one side of said wire and said forming step tends to bend said wire into a loop having said flat on the outer periphery thereof.

3. The method of claim 2 wherein said wire is guided after said forming step to provide a loop of greater size then the size of the loop created by said forming step.

4. The method of claim 3 wherein said last mentioned guiding step includes bending said wire toward a straight condition.

5. Apparatus for forming wire clips of noncircular cross section comprising:
- means for establishing a supply of wire in a continuous length,
- roller means for forming said wire to a predetermined noncircular cross section,
- guide means for guiding said formed wire in a relatively large loop,
- wire cutting and forming means for making clips, and
- feeding means for feeding said wire from said loop to said wire cutting and forming means.

6. Apparatus according to claim 5 wherein said means for establishing a supply of wire includes a drum of wire, variable speed means for rotating said drum on its periphery for feeding said wire toward said roller means.

7. Apparatus according to claim 5 wherein said roller means includes a pair of rollers driven in opposite directions at the same speed, variable speed means for driving said rollers.

8. Apparatus according to claim 7 wherein a follower is positioned in engagement with said loop, means connecting said follower with said variable speed means for automatically controlling said speed by the size of said loop.

9. Apparatus according to claim 5 wherein straightening rollers are interposed between said loop and said wire cutting and forming means for straightening the wire from said loop.

* * * * *